US010512279B1

(12) United States Patent
Muniz

(10) Patent No.: US 10,512,279 B1
(45) Date of Patent: Dec. 24, 2019

(54) TOBACCO GRINDING AND PACKING DEVICE

(71) Applicant: Gustavo Muniz, Hialeah, FL (US)

(72) Inventor: Gustavo Muniz, Hialeah, FL (US)

( * ) Notice: Subject to any disclaimer, the term of this patent is extended or adjusted under 35 U.S.C. 154(b) by 0 days.

(21) Appl. No.: 16/425,494

(22) Filed: May 29, 2019

(51) Int. Cl.
*A24B 7/04* (2006.01)
*A24C 5/39* (2006.01)

(52) U.S. Cl.
CPC ..... *A24B 7/04* (2013.01); *A24C 5/399* (2013.01)

(58) Field of Classification Search
CPC .... A24B 7/04; A24B 7/14; A24C 5/02; A24C 5/40; A24C 5/42; A24C 5/44; A24C 5/46
See application file for complete search history.

(56) References Cited

U.S. PATENT DOCUMENTS

2014/0261471 A1* 9/2014 Ruzycky ..... A24C 5/02 131/108
2016/0095473 A1* 4/2016 Perucca ..... A47J 42/14 241/100

* cited by examiner

*Primary Examiner* — Michael H. Wilson
*Assistant Examiner* — Yana B Krinker
(74) *Attorney, Agent, or Firm* — Ruben Alcoba, Esq.

(57) ABSTRACT

A tobacco grinding and packing device that allows users to pack their own cigarette papers with an herb. The device comprises of grinder that has a feeding tube and a spout. The spout feeds into a cigarette paper loader that is pivotally attached to the grinder.

1 Claim, 6 Drawing Sheets

TOBACCO GRINDING AND PACKING DEVICE

This application is a continuation of a provisional U.S. Patent application No. 62/825,819, filed on Mar. 29, 2019, being titled A Tobacco Grinding and Packing Device.

BACKGROUND

The present invention is directed to a tobacco grinding and packing device that will allow users to pack their own tobacco within a cigarette paper.

Herb smoking enthusiast enjoy packing their own cigarette papers with herbs, for it allows them to select the quality of herbs that they will inhale.

The problem with packing your own cigarettes is that many people do not have the finger dexterity to pack or roll their own herbs within a cigarette paper.

In the field of tobacco rolling, there are devices that allow a user to place a grinded substance within a roller. The devices require a user to have finger dexterity when rolling a cigarette and to have a pre-grinded herb to place within the device when rolling.

There are also electronic devices that can be used to pack a cigarette with herb. The electronic devices are large in size and are typically made for industrial use. The present invention is a handheld device that will allow a bud to be loaded within its feeder, the bud will be pushed through its grinder and then then the grounds of the bud shall be packed within a coned cigarette paper.

The inventor is not aware of any device that can be loaded with a small quantity of herbs that will serve to grind and load the herbs within a coned cigarette paper without having to manipulate the paper.

For the foregoing reason there is a need for a tobacco grinding and packing device that will allow users to pack their own cigarette papers with an herb.

SUMMARY

The present invention describes a tobacco grinding and packing device that will allow users to pack their own cigarette papers with an herb.

The tobacco grinding and packing device comprises of an oblong body that has a first and a second end and a left and a right side, the oblong body has a vertical wall that runs from the left first end of the oblong body toward the second end, the vertical wall curves around the second end of the oblong body and returns toward the first right end of the oblong body, the oblong body defines a plurality of through holes around second end of the oblong body that are located within vertical wall at the curved end of the vertical wall, the second end of the oblong body defines a circular ridge that has a central though hole. A grinding plate attaches to an inner portion of the curved section of the vertical wall. A sprocket that has a plurality of projections mounts on the circular ridge and each projection runs flush to the grinding plate. An elastic band shall be placed around the vertical wall. An oblong cover that defines a central aperture attaches to the oblong body, hereinafter the oblong cover and the attached oblong body shall be referred as a grinder, so that a feeding cavity and a passthrough channel are defined within the grinder. A stuffer shall be placed within the feeding cavity and shall be secured on to the feeding cavity via the elastic band. A cylinder that has a top and a bottom, the cylinder defines a horizontal guide and a central vertical guide, the central vertical guide has a pin at an end, the cylinder is mounted an attached to the sprocket after passing the central vertical guide through the central through hole of the ridge. A coned spout attaches to the grinder so that the plurality of through holes are positioned within the coned spout, the coned spout defines a central loading tube. A loading arm that has a first and a second end, the first end is connected to the grinder via a pivot pin and the second end defines a cigarette paper loading portion, the second end of the loading arm mounts onto the central loading tube. And a rod, the rod is placed either in the central vertical guide or the horizontal guide.

The device is used as follows: first a bud is placed within feeding cavity of the grinder; then, the stuffer is placed within the feeding cover; next, a coned cigarette paper is placed within the cigarette paper loading portion of the loading arm and the loading arm is mounted onto the central loading tube; then the rod is placed on the horizontal guide and rod is manipulated so that the sprocket turns or spins around the circular ridge so that the bud is grounded into a grounded material that passes through the plurality of through holes and falls into the cigarette paper; next placing the rod through the central vertical guide to pack the ground within the cigarette paper; and lastly, repeating the last two steps until the cigarette paper is loaded with ground to a desired consistency.

An object of the present invention is to provide a handheld tobacco grinding and packing device for packing cigarettes.

Another object of the present invention is to provide a handheld tobacco grinding and packing device that will allow people whom have minimal finger dexterity to pack their own cigarettes.

DRAWINGS

These and other features, aspects, and advantages of the present invention will become better understood with regards to the following description, appended claims, and drawings where:

DESCRIPTION

Figure 1:
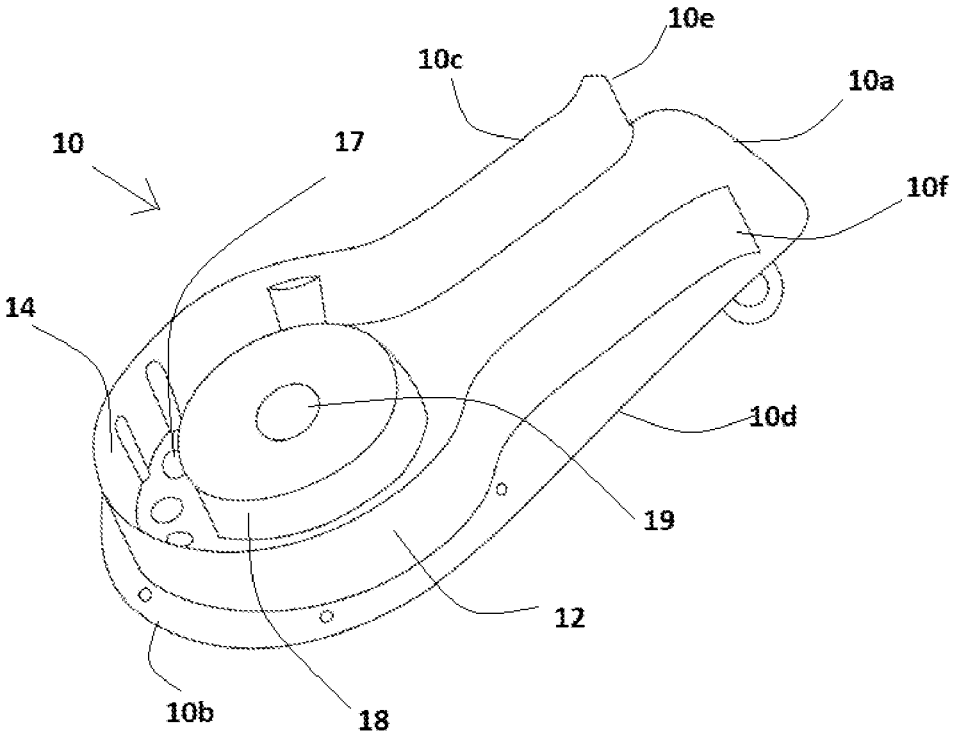
FIG. 1 is a perspective view of the oblong body of the present invention.
Figure 2:
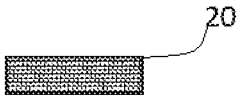
FIG. 2 is a side view of the grinding plate of the present invention.
Figure 3:
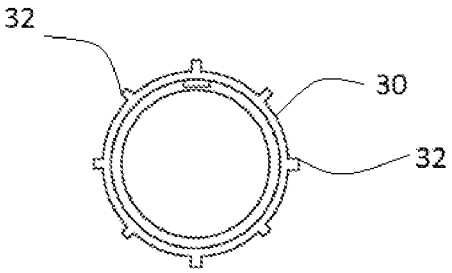
FIG. 3 is a top plan view of the sprocket of the present invention.
Figure 4:
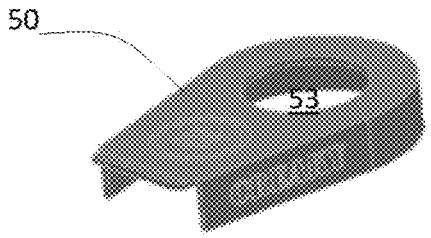
FIG. 4 is a perspective view of the oblong body of the present invention.
Figure 5:
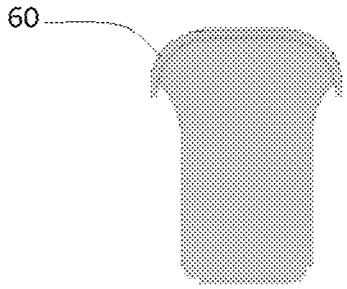
FIG. 5 is a top plan view of the stuffer of the present invention.
Figure 6:
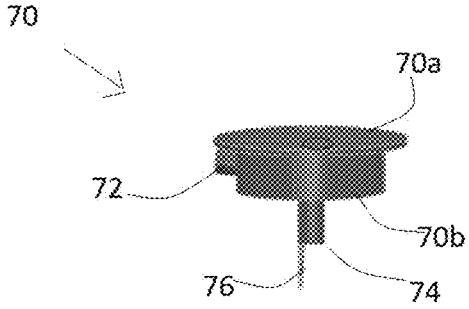
FIG. 6 is a side view of the cylinder of the present invention.
Figure 7:
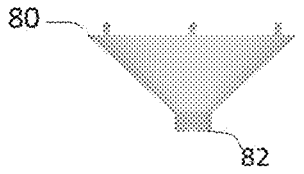
FIG. 7 is a side view of the spout of the present invention.
Figure 8:
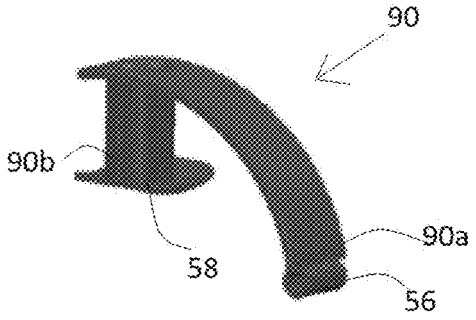
FIG. 8 is a perspective view of the loading arm.
Figure 9:
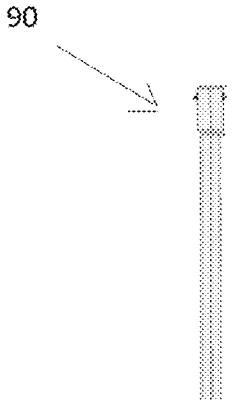
FIG. 9 is a side view of the rod of the present invention.
Figure 10:
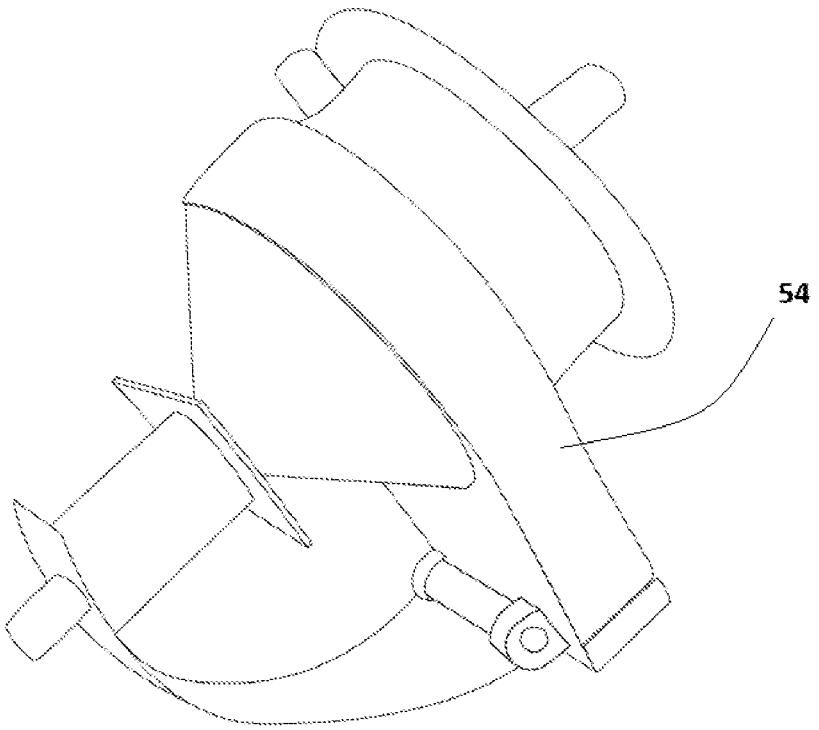
FIG. 10 is a photograph of the present invention that shows the grinder.
Figure 11:
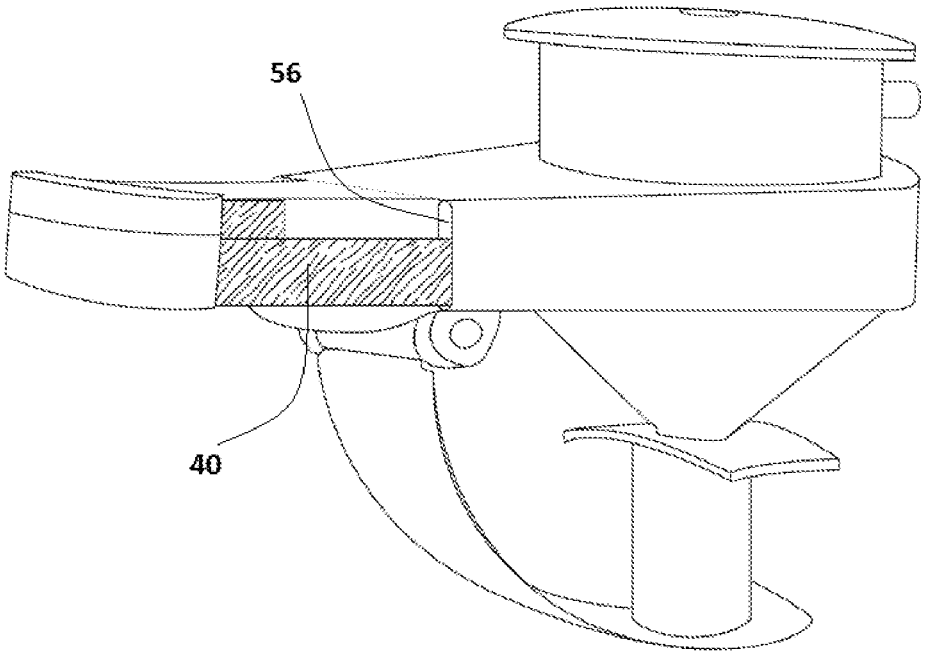
FIG. 11 is a photograph of the present invention that shows the feeding cavity and the rubber band of the present invention.

A seen in FIGS. 1-11, the present invention is directed to a tobacco grinding and packing device 100 that allows users to pack their own cigarette papers with an herb. The device comprises of an oblong body 10 that has a first end 10*a*, a second end 10*b*, a left side 10*c*, and a right side 10*d*, the oblong body has a vertical wall 12 that runs from a left first end 10*e* of the oblong body toward a right second end 10*f*, the vertical wall 12 curves around the second end 10*b* of the oblong body and returns toward the right end 10*b* of the oblong body 10 thereby defining an inner portion of the curved section 14, the oblong body 10 defines a plurality of through holes 17 around second end 10*b* of the oblong body 10 that are located within the vertical wall 12, the second end of the oblong body 10*b* defines a circular ridge 18 that has a central through hole 19. A grinding plate 20 attaches to an inner portion of the curved section 14 of the vertical wall 12. A sprocket 30 that has a plurality of projections mounts 32 on the circular ridge 18 and each projection 32 runs flush to the grinding plate 20. An elastic band 40 shall be placed around the vertical wall 12. An oblong cover 50 that defines a central aperture 53 attaches to the oblong body 10, hereinafter the oblong cover and the attached oblong body shall be referred as a grinder 54, so that a feeding cavity 56 and a pass through channel (not seen in the figures) are defined within the grinder 54. A stuffer 60 shall be placed within the feeding cavity 56 and shall be secured on to the feeding cavity 56 via the elastic band 40. A cylinder 70 that has a top 70*a* and a bottom 70*b*, the cylinder defines a horizontal guide 72 and a central vertical guide 74, the central vertical guide 74 has a pin at an end 76, the cylinder 70 is mounted an attached to the sprocket 30 after passing the central vertical guide 74 through the central through hole 19 of the circular ridge 18. A coned spout 80 attaches to the grinder 54 so that the plurality of through holes 17 are positioned within the coned spout 80, the coned spout 80 defines a central loading tube 82. A loading arm 90 that has a first end 90*a* and a second end 90*b*, the first end 90*a* is connected to the grinder 54 via a pivot pin 56 and the second end 90*b* defines a cigarette paper loading portion 58, the second end of the loading arm 90*b* mounts onto the central loading tube 82. And, a rod 90, the rod 90 is placed in either the central vertical guide 74 or the horizontal guide 72.

An advantage of the present invention is that it provides a handheld tobacco grinding and packing device for packing cigarettes.

Another advantage of the present invention is that it provides a handheld tobacco grinding and packing device that allows people whom have minimal finger dexterity to pack their own cigarettes.

The embodiments of the apparatus and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the apparatus and method should be construed as limiting the invention to a particular embodiment or combination of embodiments. The scope of the invention is defined by the appended claims.

What is claimed is:

1. A tobacco grinding and packing device that allows users to pack their own cigarette papers with an herb, the device comprises:

an oblong body that has a first end, a second end, a left side, and a right side, the oblong body has a vertical wall that runs from a left first end of the oblong body toward a right second end, the vertical wall curves around the second end of the oblong body and returns toward the right end of the oblong body thereby defining an inner portion of the curved section, the oblong body defines a plurality of through holes around the second end of the oblong body that are located within the vertical wall, the second end of the oblong body defines a circular ridge that has a central through hole;

a grinding plate attaches to the inner portion of the curved section of the vertical wall;

a sprocket that has a plurality of projections mounts on the circular ridge and each projection runs flush to the grinding plate;

an elastic band is placed around the vertical wall;

an oblong cover that defines a central aperture attaches to the oblong body forming a grinder, so that a feeding cavity and a pass through channel are defined within the grinder;

a stuffer is placed within the feeding cavity and is secured on to the feeding cavity via the elastic band;

a cylinder that has a top and a bottom, the cylinder defines a horizontal guide and a vertical guide, the vertical guide has a pin at an end, the cylinder is mounted and attached to the sprocket after passing the vertical guide through the central through hole of the circular ridge;

a coned spout attaches to the grinder so that the plurality of through holes are positioned within the coned spout, the coned spout defines a central loading tube;

a loading arm that has a first end and a second end, the first end is connected to the grinder via a pivot pin and the second end defines a cigarette paper loading portion, the second end of the loading arm mounts onto the central loading tube; and a rod, the rod is placed in either the vertical guide or the horizontal guide.

* * * * *